US012137778B2

(12) United States Patent
Filko

(10) Patent No.: US 12,137,778 B2
(45) Date of Patent: Nov. 12, 2024

(54) SYSTEMS AND METHODS FOR A CONNECTION DEVICE WITH MAGNETIC ALIGNMENT OF A LIP AND RIDGE

(71) Applicant: Nite Ize, Inc., Boulder, CO (US)

(72) Inventor: Brian Filko, Doylestown, PA (US)

(73) Assignee: Nite Ize, Inc., Boulder, CO (US)

( * ) Notice: Subject to any disclaimer, the term of this patent is extended or adjusted under 35 U.S.C. 154(b) by 266 days.

(21) Appl. No.: 17/660,776

(22) Filed: Apr. 26, 2022

(65) Prior Publication Data

US 2023/0337788 A1 Oct. 26, 2023

(51) Int. Cl.
*A44B 15/00* (2006.01)

(52) U.S. Cl.
CPC ..... *A44B 15/002* (2013.01)

(58) Field of Classification Search
CPC ..... A44B 15/00; A44B 15/002
USPC ..... 70/459
See application file for complete search history.

(56) References Cited

U.S. PATENT DOCUMENTS

| | | | | |
|---|---|---|---|---|
| 3,041,697 A | | 7/1962 | Budreck | |
| 3,108,346 A | | 10/1963 | Bey | |
| 3,111,736 A | * | 11/1963 | Budreck | A44B 15/002 70/459 |
| 3,192,747 A | * | 7/1965 | Stupell | A44B 15/002 2/338 |
| 10,309,433 B2 | | 6/2019 | Salvatore | |
| 10,584,736 B2 | | 3/2020 | Ormsbee et al. | |
| 2008/0060172 A1 | | 3/2008 | Moss | |
| 2012/0044031 A1 | * | 2/2012 | Ninomiya | A44C 5/2085 335/219 |
| 2019/0069648 A1 | * | 3/2019 | Duncan | A44C 5/2071 |

OTHER PUBLICATIONS

International Search Report from related application PCT/US23/66253 dated Oct. 19, 2023.

* cited by examiner

*Primary Examiner* — Nathan Cumar
(74) *Attorney, Agent, or Firm* — Haynes and Boone, LLP

(57) ABSTRACT

A key chain includes a bisected hollow cylinder, one side of the bisected hollow cylinder forming a first side and another side forming a second side. The key chain further includes a first holder, the first holder having a first half cylindrical body, the first holder located inside of the first side of the bisected hollow cylinder, such that a first outer radius of the first holder is coextensive with a first inner radius of the second side when interconnected. The key chain further includes a second holder, the second holder having a second half cylindrical body, the second holder located inside of the second side of the bisected hollow cylinder, such that a second outer radius of the second holder is coextensive with a second inner radius of the first side when interconnected. The key chain further includes a first magnetic material and second magnetic material, the first magnetic material located in the first holder and the second magnetic material located in the second holder, the first magnetic material and the second magnetic material oriented such that when the first side and the second side are proximate to forming a complete cylinder, the first holder is guided to the second holder through magnetism between the first magnetic material and the second magnetic material.

20 Claims, 10 Drawing Sheets

SYSTEMS AND METHODS FOR A CONNECTION DEVICE WITH MAGNETIC ALIGNMENT OF A LIP AND RIDGE

BACKGROUND

Frequently a user may have several sets of keys. In various settings, it may be desirable to quickly attach and detach sets of keys from each other. Speed of detachment is important to the user, however, a secure attachment is important as well. It may be difficult to combine both rapid detachment and secure detachment.

BRIEF SUMMARY

In one embodiment, a key chain includes a bisected hollow cylinder, one side of the bisected hollow cylinder forming a first side and another side forming a second side. The key chain further includes a first holder, the first holder having a first half cylindrical body, the first holder located inside of the first side of the bisected hollow cylinder, such that a first outer radius of the first holder is coextensive with a first inner radius of the second side when interconnected. The key chain further includes a second holder, the second holder having a second half cylindrical body, the second holder located inside of the second side of the bisected hollow cylinder, such that a second outer radius of the second holder is coextensive with a second inner radius of the first side when interconnected. The key chain further includes a first magnetic material and second magnetic material, the first magnetic material located in the first holder and the second magnetic material located in the second holder, the first magnetic material and the second magnetic material oriented such that when the first side and the second side are proximate to forming a complete cylinder, the first holder is guided to the second holder through magnetism between the first magnetic material and the second magnetic material. Alternatively, first length of the first holder is less than a second length of the bisected hollow cylinder. In one alternative, the first holder is located at a first end of the first side and a second end of the first side includes a first lip, the first lip oriented to rest on a first ridge of the second holder when the first side and the second side are engaged. Alternatively, a third length of the second holder is less than a fourth length of the bisected hollow cylinder and the second holder is located at a third end of the second side and a fourth end of the second side includes a lip, the lip oriented to rest on a ridge of the second holder when the first side and the second side are engaged. In another alternative, the key chain further includes a keyring attached to the first holder. Alternatively, the first side and the first holder combination and the second side and the second holder combination are identical.

In another embodiment, connection device with automatic alignment, the connection device includes a first side and a second side, the first side having a first complementary receiver for a first end of the second side. The connection device further includes a first magnetic material and a second magnetic material, the first magnetic material located in the first side, the second magnetic material located in the second side, the first magnetic material and the second magnetic material oriented such that when the first side and the second side are proximate, the first end of the second side is guided into the first complementary receiver through magnetism. The first complementary receiver includes a first lip and the second side includes a first ridge for receiving the lip such that when the first end of the second side is guided into the first complementary receiver the lip engages with the ridge, and engagement of the ridge with the lip prevents the separation of the first side and the second side at least in a first direction. Alternatively, the second side has a second complementary receiver for a second end of the first side; the first magnetic material and the second magnetic material oriented such that when the first side and the second side are proximate, the second end of the first side is guided into the second complementary receiver through magnetism and the second complementary receiver includes a second lip and the second side includes a second ridge for receiving the first lip such that when the second end of the first side is guided into the second complementary receiver the second lip engages with the second ridge, and engagement of the second ridge with the second lip prevents the separation of the first side and the second side at least in a second direction.

In one alternative, the first side and the second side are identical. In another alternative, the first end and the second end are cylindrical, such that a first portion of the second end is a first half-cylinder and the first complementary receiver has a shape that covers and matches the first half-cylinder and a second portion of the first end is a second half-cylinder and the second complementary receiver has a shape that covers and matches the second half-cylinder. Alternatively, the first complementary receiver extends past the first end and the second complementary receiver extends past the second end, such that when the first and second side are engaged, ends of the first end and the second end are in contact. In another alternative, at least one of the first and second side include a tab for assisting in separating the first side and the second side. Alternatively, at least one of the first magnetic material and the second magnetic material is a permanent magnet. In another alternative, at least one of the first magnetic material and the second magnetic material is a magnetizable material and not a permanent magnet. Alternatively, the first side includes a key ring. In another alternative, the key ring is rotationally mounted to the first side. Alternatively, the second ridge is adjacent to the key ring, such that when the second lip is engaged with the second ridge they form an engaged pair that resists separation of the first side from the second side when the key ring is pulled on.

In one embodiment, a method of connecting end of a keychain includes providing a key chain. The key chain includes a bisected hollow cylinder, one side of the bisected hollow cylinder forming a first side and another side forming a second side; a first holder, the first holder having a first cylindrical body, the first holder located inside of the first side of the bisected hollow cylinder, such that a first outer radius of the first holder is coextensive with a first inner radius of the second side when interconnected; a second holder, the second holder having a second cylindrical body, the second holder located inside of the second side of the bisected hollow cylinder, such that a second outer radius of the second holder is coextensive with a second inner radius of the second side; and a first magnetic material and second magnetic material, the first magnetic material located in the first holder and the second magnetic material located in the second holder. The method includes moving the first magnetic material into a position proximate to the second magnetic material. The method includes connecting the first side and the second side. The method includes forming a complete cylinder, wherein the first holder is guided to the second holder through magnetism between the first magnetic material and the second magnetic material. Alternatively, the key chain further includes a keyring attached to the first holder and the method further includes attaching a key to the keyring. In one alternative, the first side and the first holder combination and the second side and the second holder combination are identical.

DETAILED DESCRIPTION

Figure 3:
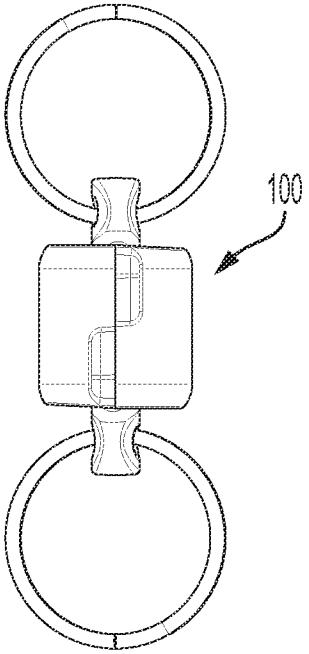
FIG. 3 shows another view of the connection device of FIG. 1.

Certain terminology is used herein for convenience only and is not to be taken as a limitation on the embodiments of the systems and methods for a connection device with magnetic alignment of a lip and ridge (CDMA). In many embodiments, the CDMA includes a bisected body forming two sections. The term bisected does not necessarily mean in half (to form two equal sides), however the bisection may be in half. Furthermore, the bisected body may be cut, or each half may be formed separately. Each section (side) of the bisected body has a void portion and an internal holder portion. The void portion is shaped to receive the internal holder portion, such that the bisected body may be reformed. In each internal holder portion a magnetic material is housed. The magnetic material in each section aligns with the magnetic material in the other section via magnetic attraction, such that the bisected body is aligned to be reformed. Additionally in some configurations, the end of the void portion on each section may have a lip on one end that fits onto the holder portion to further connect the sections in a removable, but secure fashion. Additionally in some configurations, the internal holder portions are located on one end of each section. The internal holder portion includes a keychain connector at one end, which includes a keyring. The keychain connector may rotate and is rotationally connected to the internal holder. Since the key chain connector are located on either end, the lip fitting on the holder is oriented to resist movement in the primary lateral movement direction of the key rings. In some configurations, the bisected body is a geometric shell open at either end. The shape of the geometric shell may be cylindrical, prismatic, or other shape. The prismatic shape has an internal perimeter. The internal holder (each one) is located in one section such that when the sections are combined the internal holder juts into the other section. The internal holder is shaped such that its external perimeter matches the internal perimeter of the other section for a secure fit. In many configurations, the end of the geometric shell of each section of the body that is opposite the internal holder is open and includes the lip. Therefore, when it aligns with the opposite section, which is essentially a flipped version of the first section, the lip interfaces with the internal holder of the opposite side to prevent easy separation. The magnetic material (which one or more of which may be magnets) are in the internal holders and align in the center of the device to hold the sides together. Additionally, in some configurations the sections may have tabs to assign in separation. The tabs may be located along the bisected cut between the two sections. In many configurations, the two sections of the bisected body are identical and flipped so they may align and combine. In many configurations, the device is a keychain. In many alternatives, it may be any other item of which the function is improved via the magnetic interconnection system. Examples, include, but are not limited to, connectors for toys, connectors for flashlights, connectors for pens or pencils, connectors for medical devices, connectors for tools, rapid exchange of tool tips, etc.

Figure 2:
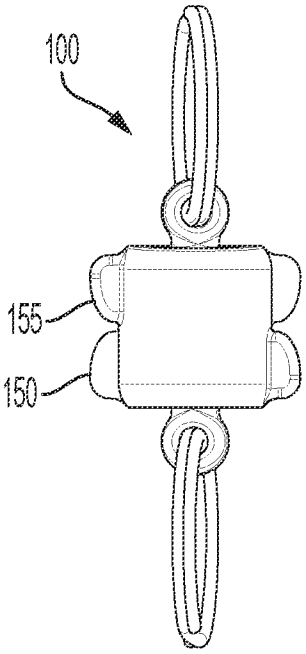
FIG. 2 shows another view of the connection device of FIG. 1.
Figure 1:
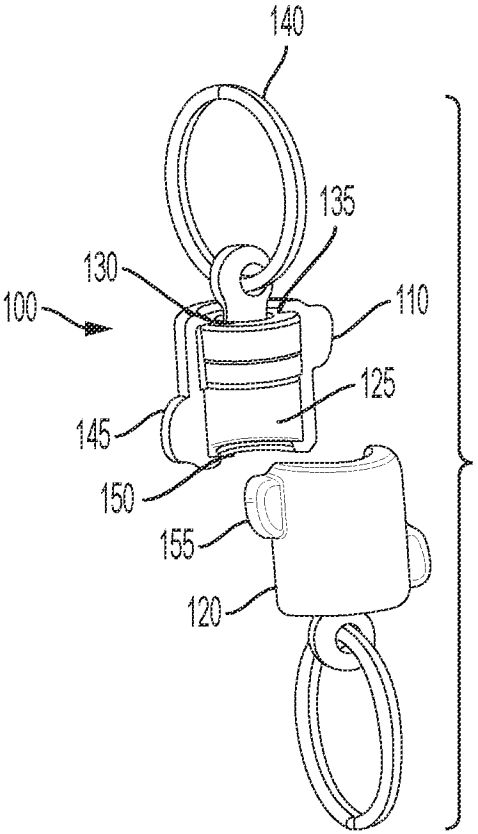
FIG. 1 shows one embodiment for a connection device with magnetic alignment of a lip and ridge.

FIG. 1 shows one embodiment of a CDMA 100. CDMA 100 includes a first side 110 and a second side 120. As shown, first side 110 and second side 120 are mirror images. Each side 110, 120 includes a holder 135 for a magnet (shown in FIG. 4). Each side includes a rotating connector 130 inserted into the holder 135. Rotating connector 130 is attached to key ring 140 for attaching keys to the end. Rotating connector 130 may rotate inside of holder 135. In some alternatives, the device may not have a rotating connector, simply a connector. The rotating connector may offer some advantages, since the rotating nature tends to reduce accidental disconnection of the sides that might occur if a key ring was levered against a surface. This is because the rotating nature tends to rotate out of such a levered position. Side 110, 120 are essentially halves of a bisected cylinder with open ends. Each holder 135 is a half cylinder that has an outer radius that is equal to the inner radius of each side 110, 120, that may fit into each side 110, 120. Alternatively, the design may be a single formed piece instead of a separate hold and side. Although the design shown is cylindrical, square or octagon, or other shaped designs may be used. The rounded design is typically optimal, since many magnets utilized also have a rounded shape. Any shape that may be bisected may be used, however. The void 125 (also called a receiver) is shaped to complement the holder on the opposite side, such that each void 125 may receive the corresponding holder 135 and reform the bisected cylinder. Additionally, lip 150 is visible. Lip 150 fits on the exposed top portion (ridge) of the corresponding holder and prevents separation of the sides 110, 120. Because of the arrangement of the device, the lip and ridge connection resists the most likely direction for separation. This can be appreciated in FIGS. 2 and 3, which show the device interconnected. In operation, when the sides are proximate, the magnetic attraction between the holders due to the housed magnetic material automatically aligns them. This is most optimal in the case of two magnets, as the poles will be aligned in a north-south fashion, with the magnets mounted on one side such that the south pole faces internally and on the other such that the north pole faces internally. When it is indicted that the sides are identical, it is meant that they are structurally identical, except for the orientation of the magnets, which are opposite. Because of the location of the key rings, separating force is most likely and strongest in line with the rings 140 instead of laterally at the bisection point of the two bisected halves of the cylinder. There are few if any leverage points exist when the cylinder is reformed/connected. In order to provide for the user to separate the cylinder, small leverage points, tabs 145, 155 are provided, such that only intentional manipulation of these tabs may provide for separation. Although in the embodiment shown, the CDMA is in the context of a keychain, in alternative embodiments, the CDMA may be deployed with the loops on the end of a different shape or deployed with a different connector such as a lanyard or a string in place of the keyring. The ends of the CDMA may be configured to include any type of device or end around the central CDMA. FIGS. 2 and 3 show views of the interconnected device.

Figure 4:
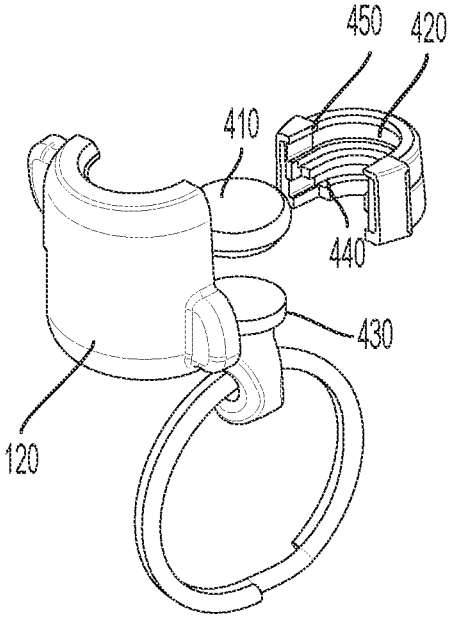
FIG. 4 shows an exploded view of one side of the connection device of FIG. 1.

FIG. 4 shows an exploded view of one side 120 of CDMA 100. As shown in the exploded view, magnet 410 fits into slot 420. Similarly, end 430 of rotating connector 130 may be captured in slot 440. As show, the holder may have a snap-fit arrangement 450 on its end to interface with the side 120. The slots and snap-fit arrangement 450 are purely exemplary, various arrangements or ways of holding the magnet and rotating end in place are possible.

Figure 5:
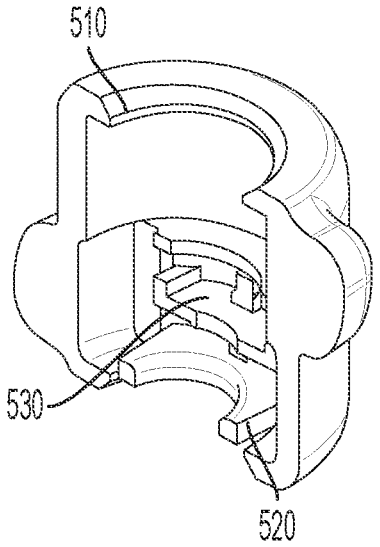
FIG. 5 shows one embodiment of a holder portion of the connection device of FIG. 1.
Figure 6:
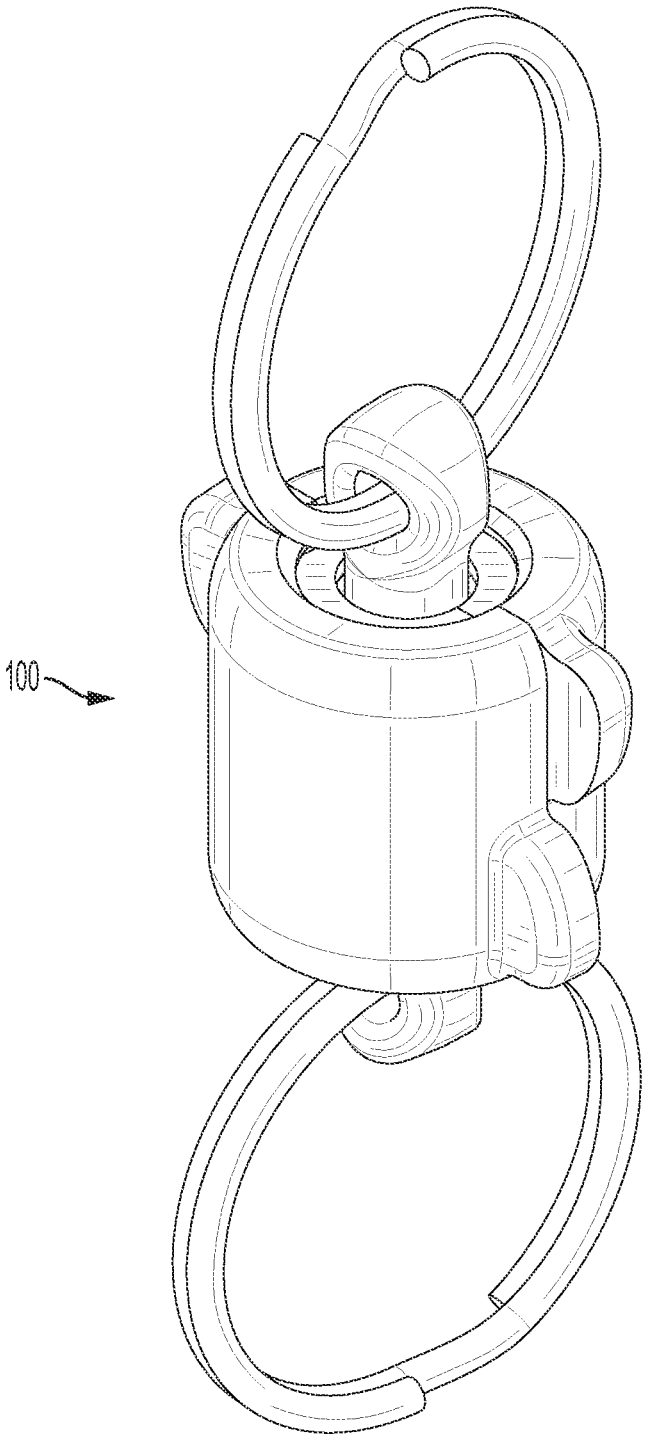
FIG. 6 shows a perspective view of the connection device of FIG. 1.
Figure 7:
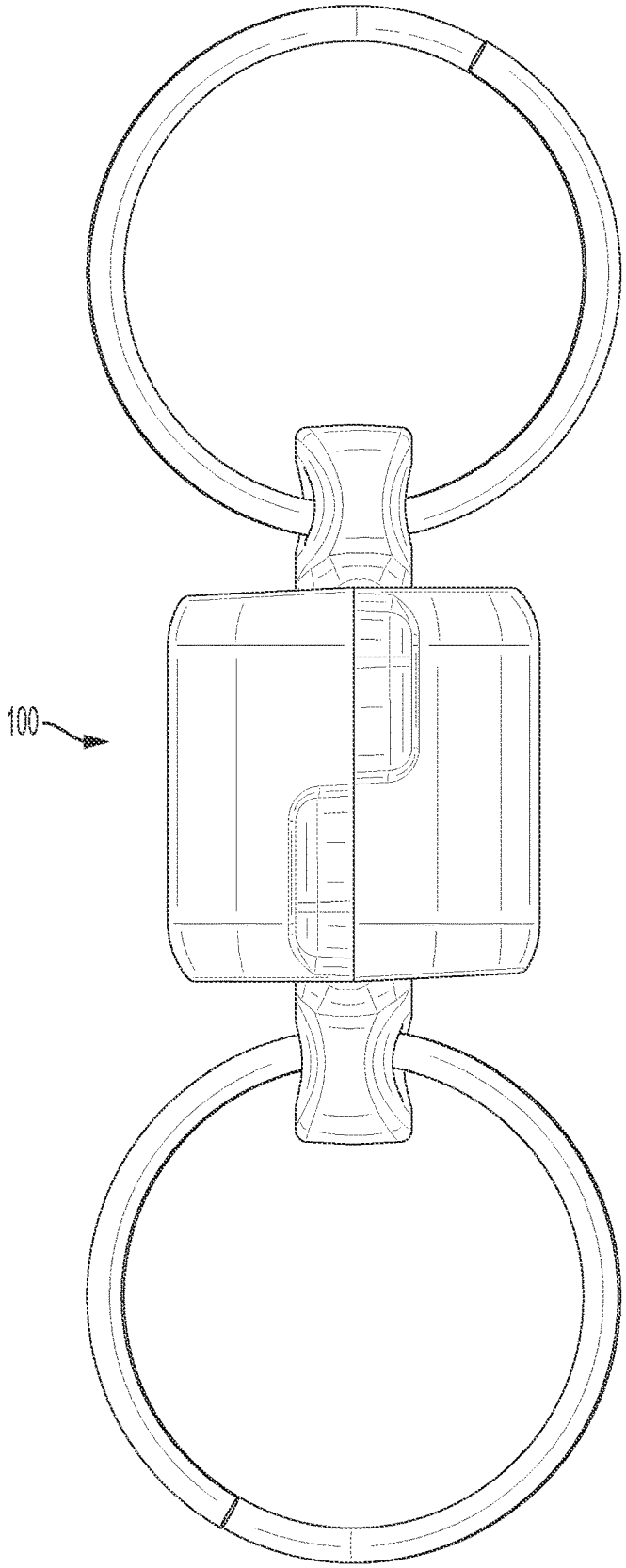
FIG. 7 shows a left-side view of the connection device of FIG. 1.
Figure 8:
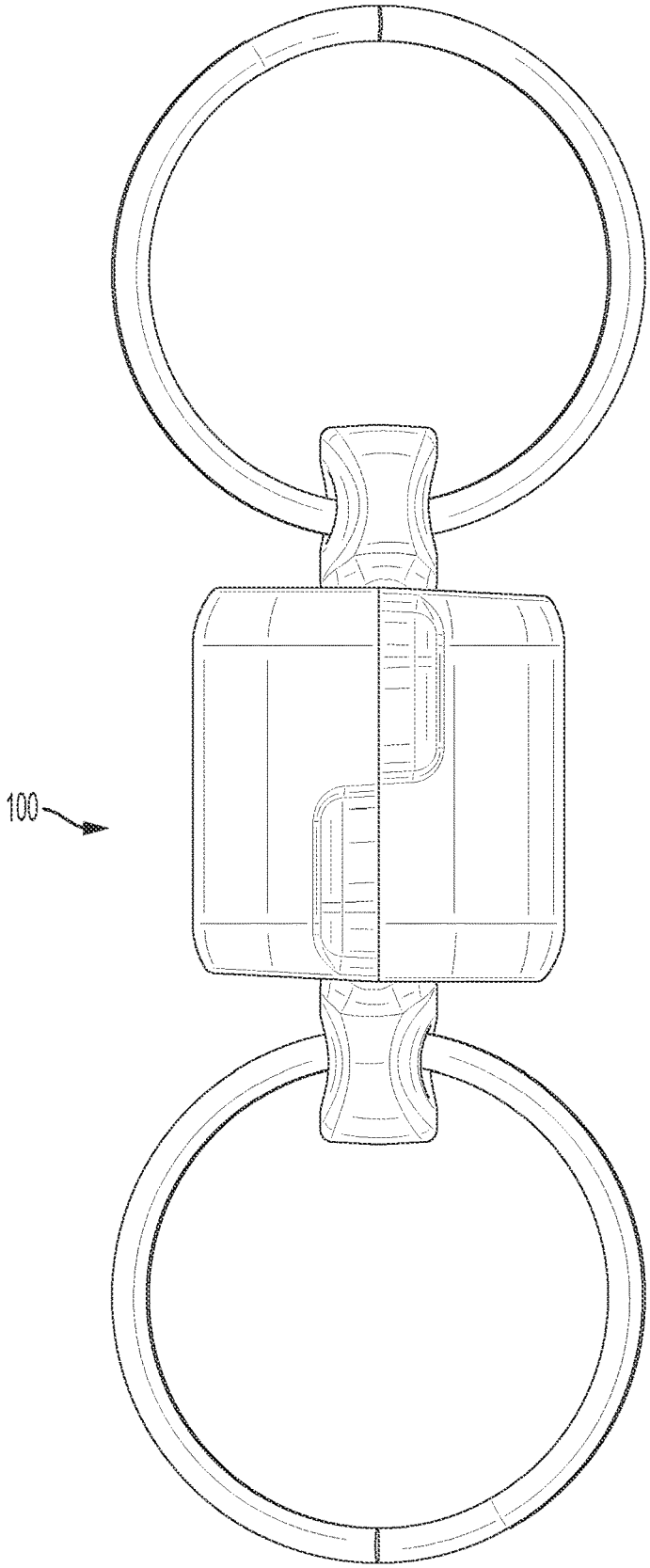
FIG. 8 shows a right-side view of the connection device of FIG. 1.
Figure 9:
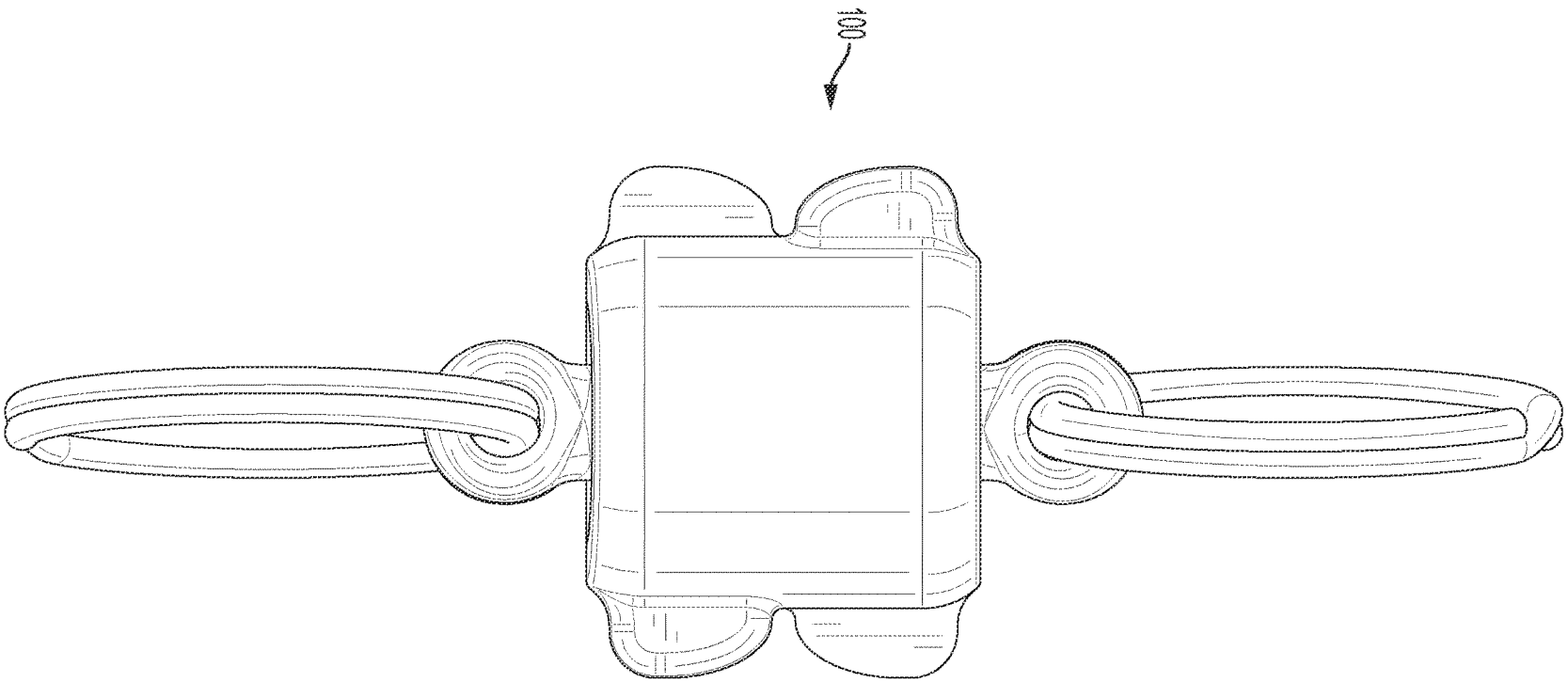
FIG. 9 shows a front view of the connection device of FIG. 1.
Figure 10:
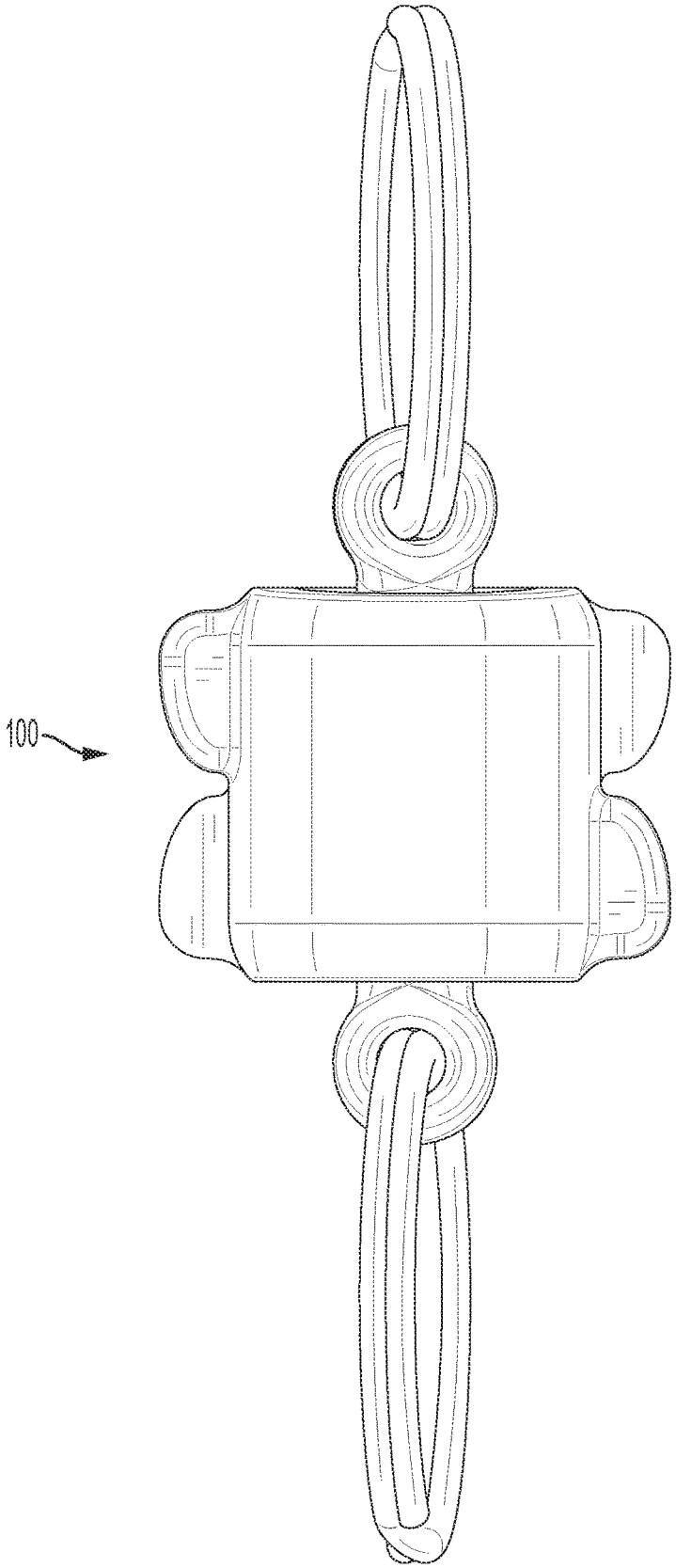
FIG. 10 shows a rear view of the connection device of FIG. 1.
Figure 11:
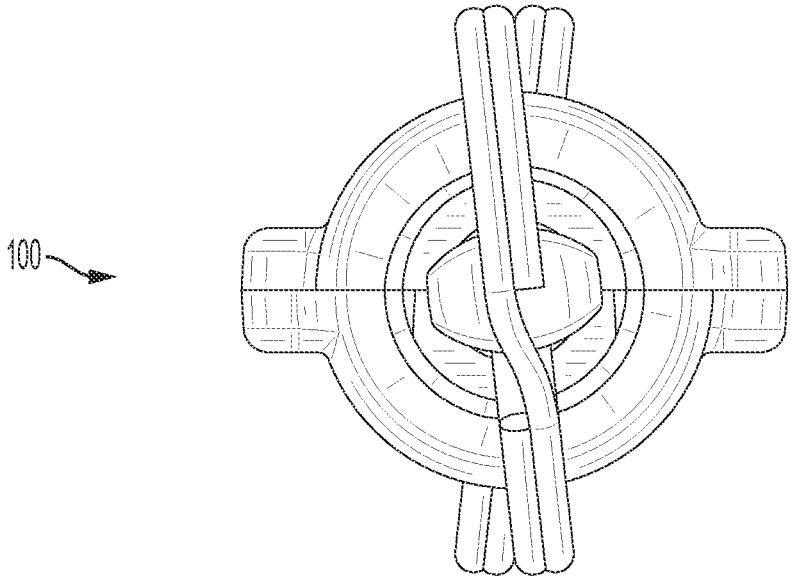
FIG. 11 shows a tope view of the connection device of FIG. 1.
Figure 12:
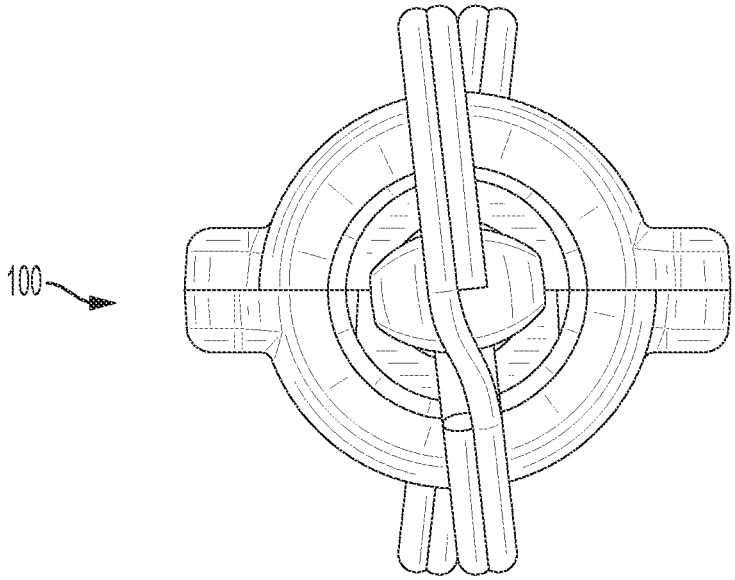
FIG. 12 shows a bottom view of the connection device of FIG. 1.

FIG. 5 shows a view of one of the symmetrical sides. Visible in this view is the holder for end 430 of rotating connector 130 as well as the shelf 530 for magnet 410. Shelf 530 also provides for a snap fit arrangement of snap-fit arrangement 450. Importantly, lip 510 is clearly visible. This lip 510 interfaces with a flipped version of holder 135 and sits on the ridge of the holder.

Various different arrangements of the CDMA are possible. In many embodiments, the embodiments include a shape that may be bisected along its length, such that two halves are formed. Each half has two parts, one which is hollow such that a void or receiver area is formed and the other which holds a magnet and is shaped to fit into the void/receiver area (holder). This makes up the connector, such that a bisected shape with a void and holder may be fitted with the identical other half and held together via magnetism. Additionally, although in many embodiments two magnets are used, in alternatives one may not be a magnet but merely a material attracted to the other magnet. Generally, magnetic material includes material that is either a magnet or a material attracted by a magnet. Additionally, in many configurations, tabs for separation are included. Finally, the lips on the ends that fit over the holder pieces onto a ridge of the holder provide greater resistance to separation. In use, the magnets and the shape of such devices lead to automatic alignment, which greatly eases secure connection. Also, although the device is described in the context of a keychain the device may be used in other contexts. In some embodiments, the various sides of the device may be connected to each other and then one may be detached and connected to a third side that is identical or different from the previously interconnected side. For example, a base with a holder might be provided having one half of the CDMA. The second half might have a tool tip. A third half might have another tool tip that could be exchanged.

While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A key chain comprising:

a bisected hollow cylinder, one side of the bisected hollow cylinder forming a first side and another side forming a second side;

a first holder, the first holder having a first half cylindrical body, the first holder located inside of the first side of the bisected hollow cylinder, such that a first outer radius of the first holder is coextensive with a first inner radius of the second side when interconnected;

a second holder, the second holder having a second half cylindrical body, the second holder located inside of the second side of the bisected hollow cylinder, such that a second outer radius of the second holder is coextensive with a second inner radius of the first side when interconnected;

a first magnetic material and second magnetic material, the first magnetic material located in the first holder and the second magnetic material located in the second holder, the first magnetic material and the second magnetic material oriented such that when the first side and the second side are proximate to forming a complete cylinder, the first holder is guided to the second holder through magnetism between the first magnetic material and the second magnetic material, wherein the first magnetic material and the second magnetic material are each magnets.

2. The key chain of claim 1, wherein a first length of the first holder is less than a second length of the bisected hollow cylinder.

3. The key chain of claim 2, wherein the first holder is located at a first end of the first side and a second end of the first side includes a first lip, the first lip oriented to rest on a first ridge of the second holder when the first side and the second side are engaged.

4. The key chain of claim 3, wherein a third length of the second holder is less than a fourth length of the bisected hollow cylinder and the second holder is located at a third end of the second side and a fourth end of the second side includes a lip, the lip oriented to rest on a ridge of the second holder when the first side and the second side are engaged.

5. The key chain of claim 4, further comprising:

a first keyring attached to the first holder and a second keyring attached to the second holder, and poles of the first magnetic material and the second magnetic material are aligned in a north-south fashion such that a south pole faces internally and on an other such that a north pole faces internally, thereby providing a separating force that strongest in line with the first keyring and the second keyring.

6. The keychain of claim 1, wherein the first side and the first holder combination and the second side and the second holder combination are identical.

7. A connection device with automatic alignment, the connection device comprising:

a first side and a second side, the first side having a first complementary receiver for a first end of the second side;

a first magnetic material and a second magnetic material, the first magnetic material located in the first side, the second magnetic material located in the second side, the first magnetic material and the second magnetic material oriented such that when the first side and the second side are proximate, the first end of the second side is guided into the first complementary receiver through magnetism;

wherein the first complementary receiver includes a first lip and the second side includes a first ridge for receiving the lip such that when the first end of the second side is guided into the first complementary receiver the lip engages with the ridge, and engagement of the ridge with the lip prevents the separation of the first side and the second side at least in a first direction, wherein the first magnetic material and the second magnetic material are each magnets.

8. The connection device of claim 7, wherein the second side has a second complementary receiver for a second end of the first side; the first magnetic material and the second magnetic material oriented such that when the first side and the second side are proximate, the second end of the first side is guided into the second complementary receiver through magnetism;

wherein the second complementary receiver includes a second lip and the second side includes a second ridge for receiving the first lip such that when the second end of the first side is guided into the second complementary receiver the second lip engages with the first ridge, and engagement of the first ridge with the second lip prevents the separation of the first side and the second side at least in a second direction.

9. The connection device of claim 8, wherein the first end and the second end are cylindrical, such that a first portion of the second end is a first half-cylinder and the first complementary receiver has a shape that covers and matches the first half-cylinder and a second portion of the first end is a second half-cylinder and the second complementary receiver has a shape that covers and matches the second half-cylinder.

10. The connection device of claim 9, wherein the first complementary receiver extends past the first end and the second complementary receiver extends past the second end, such that when the first and second side are engaged, ends of the first end and the second end are in contact.

11. The connection device of claim 10, wherein at least one of the first and second side include a tab for assisting in separating the first side and the second side.

12. The connection device of claim 11, wherein at least one of the first magnetic material and the second magnetic material is a permanent magnet.

13. The connection device of claim 11, wherein at least one of the first magnetic material and the second magnetic material is a magnetizable material and not a permanent magnet.

14. The connection device of claim 11, wherein the first side includes a key ring.

15. The connection device of claim 14, wherein the key ring is rotationally mounted to the first side.

16. The connection device of claim 15, wherein the second ridge is adjacent to the key ring, such that when the second lip is engaged with the second ridge they form an engaged pair that resists separation of the first side from the second side when the key ring is pulled on.

17. The connection device of claim 7, wherein the first side and the second side are identical but have opposite orientation.

18. A method of connecting end of a keychain, the method comprising:

providing a key chain including:

a bisected hollow cylinder, one side of the bisected hollow cylinder forming a first side and another side forming a second side;

a first holder, the first holder having a first half cylindrical body, the first holder located inside of the first side of the bisected hollow cylinder, such that a first outer radius of the first holder is coextensive with a first inner radius of the second side when interconnected;

a second holder, the second holder having a second half cylindrical body, the second holder located inside of the second side of the bisected hollow cylinder, such that a second outer radius of the second holder is coextensive with a second inner radius of the first side when interconnected;

a first magnetic material and second magnetic material, the first magnetic material located in the first holder and the second magnetic material located in the second holder, wherein the first magnetic material and the second magnetic material are each magnets;

moving the first magnetic material into a position proximate to the second magnetic material;

connecting the first side and the second side;

forming a complete cylinder, wherein the first holder is guided to the second holder through magnetism between the first magnetic material and the second magnetic material.

19. The method of claim 18, wherein the key chain further includes a keyring attached to the first holder and the method further includes attaching a key to the keyring.

20. The method of claim 19, wherein the first side and the first holder combination and the second side and the second holder combination are identical but have opposite orientation.

* * * * *